US008602398B2

(12) United States Patent
Hayasi et al.

(10) Patent No.: US 8,602,398 B2
(45) Date of Patent: Dec. 10, 2013

(54) BATHROOM SAUNA DEVICE

(75) Inventors: Kyou Hayasi, Gifu (JP); Yoshihiro Nishizuru, Aichi (JP)

(73) Assignee: Panasonic Corporation, Osaka (JP)

( * ) Notice: Subject to any disclaimer, the term of this patent is extended or adjusted under 35 U.S.C. 154(b) by 225 days.

(21) Appl. No.: 13/365,316

(22) Filed: Feb. 3, 2012

(65) Prior Publication Data

US 2012/0131743 A1 May 31, 2012

Related U.S. Application Data

(62) Division of application No. 12/446,623, filed as application No. PCT/JP2007/070587 on Oct. 23, 2007, now Pat. No. 8,132,795.

(30) Foreign Application Priority Data

Oct. 23, 2006 (JP) ..... 2006-287284

(51) Int. Cl.
*B01F 3/04* (2006.01)

(52) U.S. Cl.
USPC ..... 261/130; 261/78.2; 261/142; 4/524

(58) Field of Classification Search
USPC ..... 261/28, 30, 78.2, 81, 108, 115, 129, 261/130, 142, DIG. 65; 4/524
See application file for complete search history.

(56) References Cited

U.S. PATENT DOCUMENTS 3,105,892 A * 10/1963 Knapp ..... 392/368
3,869,529 A * 3/1975 Follette ..... 261/130
4,003,967 A * 1/1977 Potvin ..... 261/30
4,327,697 A * 5/1982 Wada et al. ..... 123/549
4,711,294 A * 12/1987 Jacobs et al. ..... 165/230
4,752,423 A * 6/1988 Wong ..... 261/142
4,833,739 A 5/1989 Sakakibara et al.
5,350,117 A * 9/1994 Kleinberger et al. ..... 239/428.5
5,651,498 A * 7/1997 Meyer et al. ..... 236/44 C
5,702,648 A * 12/1997 White et al. ..... 261/142
6,092,794 A * 7/2000 Reens ..... 261/115
7,022,244 B2 * 4/2006 Sakaida et al. ..... 216/2
7,308,723 B2 * 12/2007 Nunokawa ..... 4/524
7,896,319 B2 * 3/2011 Fujii et al. ..... 261/28

FOREIGN PATENT DOCUMENTS

JP 63-238864 A 10/1988
JP 6-29540 4/1994
JP 6-29540 U 4/1994
JP 6-327741 11/1994
JP 6-327741 A 11/1994
JP 3532646 B 3/2004

(Continued)

OTHER PUBLICATIONS

International Search Report of PCT Application No. PCT/JP2007/070587 dated Jan. 29, 2008.

*Primary Examiner* — Charles Bushey
(74) *Attorney, Agent, or Firm* — Panasonic Patent Center

(57) ABSTRACT

A bathroom sauna device having a heating device for heating air in a bathroom, a humidifying device for humidifying the air in the bathroom, and an airflow path for sending the air, which is adjusted in temperature and humidity by the heating device and humidifying device, to the bathroom. The temperature and humidity of the air in the bathroom are controlled by the heating device and humidifying device to a temperature and humidity immediately before which a human body starts sweating.

18 Claims, 14 Drawing Sheets

(56) References Cited

FOREIGN PATENT DOCUMENTS

| | | |
|---|---|---|
| JP | 2005-278782 | 10/2005 |
| JP | 2005-278782 A | 10/2005 |
| JP | 2006-136651 | 6/2006 |
| JP | 2006-136651 A | 6/2006 |
| JP | 2006-212246 | 8/2006 |
| JP | 2006-212246 A | 8/2006 |

* cited by examiner

BATHROOM SAUNA DEVICE

CROSS-REFERENCE TO RELATED APPLICATIONS

The present application is a divisional application of U.S. patent application Ser. No. 12/446,623 filed on Apr. 22, 2009, which issued as U.S. Pat. No. 8,132,795 on Mar. 13, 2012. U.S. patent application Ser. No. 12/446,623 was a national phase application of PCT/JP2007/070587 filed on Oct. 23, 2007 and claimed foreign priority to Japanese Patent Application 2006-287284 filed on Oct. 23, 2006.

TECHNICAL FIELD

The present invention relates to a bathroom sauna device for heating and humidifying inside a bathroom chamber.

BACKGROUND ART

A conventional bathroom sauna device in the category under discussion has an airflow path which connects air intake with blow out opening directed towards a bathroom chamber. The airflow path is provided at the inside with a humidifying device which sprays warm water. Thereby, heated and humidified air is sent into the bathroom chamber. (Patent Document 1 below is a known example of documents describing the conventional technology).

Outline structure of a conventional bathroom sauna device is described referring to FIG. 14. As illustrated in FIG. 14, a conventional bathroom sauna device includes main body 104 which has blow out opening 101 and air intake 102 coupled through by airflow path 103. Main body 104 includes hot water supply member 106, air supply member 107 and heating member 108.

Hot water supply member 106 is mounted at the upper part of main body 104 for spraying hot water from above air-water contact section 105 in airflow path 103. Air supply member 107 is mounted at the upper part of main body 104 for forming an air stream within main body 104, from air intake 102 to blow out opening 101 by way of airflow path 103. Heating member 108 is provided at a location before blow out opening 101 for heating the air of airflow path 103.

In the above-structured bathroom sauna device, hot water supply member 106 supplies hot water to air-water contact section 105 of main body 104. When a stream of air is formed by air supply member 107 from air intake 102 of main body 104 through airflow path 103 to blow out opening 101, the air gets contact with hot water supplied to air-water contact section 105. The air thus heated and humidified is blown out from blow out opening 101 to the outside of main body 104.

Since a conventional bathroom sauna aims as its main objective to cause sweating, it is generally required to raise the temperature to as high as approximately 40° C., or a sweating temperature. So, it is a generally practiced design to dispose a means for heating the air at the blow out opening of bathroom sauna device. The air is heated at the blow out opening of bathroom sauna device to provide a high temperature air. However, it is not possible to raise relative humidity of the air.

Meanwhile, along with recent change in the bathing habits, people now expect beauty promotion effects with sauna bathing, in addition to health promotion through sweating. The conventional bathroom sauna devices, however, can not meet the requirements. The essential function expected with the sauna bathing for beauty promotion is to preserve an intrinsic moisture-keeping mechanism of the skin. In the conventional sauna devices, the air temperature of a chamber to be heated and humidified is raised to as high as approximately 40° C., or a temperature at which sweating starts. When a bathing person wipes sweat off with a towel, skin surface lipids and the like components essential for keeping the skin moisture may sometimes be inadvertently removed together with sweat. Even if he or she applies a cosmetic lotion to the skin, it might flow down together with the sweat, nullifying the effect of skin moistening. Further, the skin surface lipids and the like moisture-keeping component might be washed off by the sweat.

As described in the above, in the conventional bathroom sauna devices which primarily intend to cause sweating, the intrinsic moisture-keeping mechanism of the skin is impaired. So, they can not satisfy the recent requirements of beauty promotion which pursues to preserve the skin moisture.

[Patent Document 1] Japanese Patent No. 3532646.

SUMMARY OF THE INVENTION

A bathroom sauna device in the present invention includes a heating device for heating air of a bathroom chamber, a humidifying device for humidifying the air of the bathroom chamber, and an airflow path for sending the air, which is adjusted in temperature and humidity by the heating device and the humidifying device, to the bathroom chamber. The temperature and humidity of the air in the bathroom chamber are controlled by the heating device and humidifying device to a temperature and humidity immediately before which a human body starts sweating.

The bathroom sauna device can suppress sweating of a human body and make pores of the skin enlarged. As the results, the skin can absorb sufficient amount of humidity to bring the skin moistened and more beautiful.

REFERENCE MARKS IN THE DRAWINGS

1 Bathroom Sauna Device
2 Outer Case
3 Heater
4 Cross Flow Fan
5 Humidifying Section
6 Spray Nozzle
7 Water Particle Crusher
8 Eliminator
9 Anti-splash Plate
10 Heat Generating Element
11 Heat Conducting Fin
12 Temperature Sensor
13 Splashing Water Particle
100 Bathroom Chamber
101 Blow Out Opening
102 Air Intake
103 Airflow Path
104 Main Body
105 Air-Water Contact Section
106 Hot Water Supply Member
107 Air Supply Member
108 Heating Member
109 Sauna Device
110 Front Panel
111 Sauna Module
112 Opening
113 Ventilation Unit
114 Control Unit
115 Filter
116 Louver
117 Louver Control Motor
118 Motor
120 Drain Section
122 Drain Pipe
123 Float Switch
124 Water Supply Channel
125 Electro-magnetic Valve
128 Ventilation Fan
129 Discharge Duct
130 Damper
131 Damper Control Motor
141 Controller, at the outside of bathroom
142 Controller, in the bathroom chamber
143 Skin Moistening Mode Switch
144 Temperature Setting Switch
145 Temperature Display
146 Sweat Sensor
151 Point A
152 Point B
153 Point C
154 Point D
155 Point E
156 Surface Dew Condensation
157 Line A

DETAILED DESCRIPTION OF PREFERRED EMBODIMENT

An exemplary embodiment of the present invention is described below with reference to the drawings. Those portions of a bathroom sauna device in the present embodiment having identical functions as those of conventional sauna device are designated using the identical symbols, and detailed description on which portions are eliminated.

Exemplary Embodiment

Figure 1:
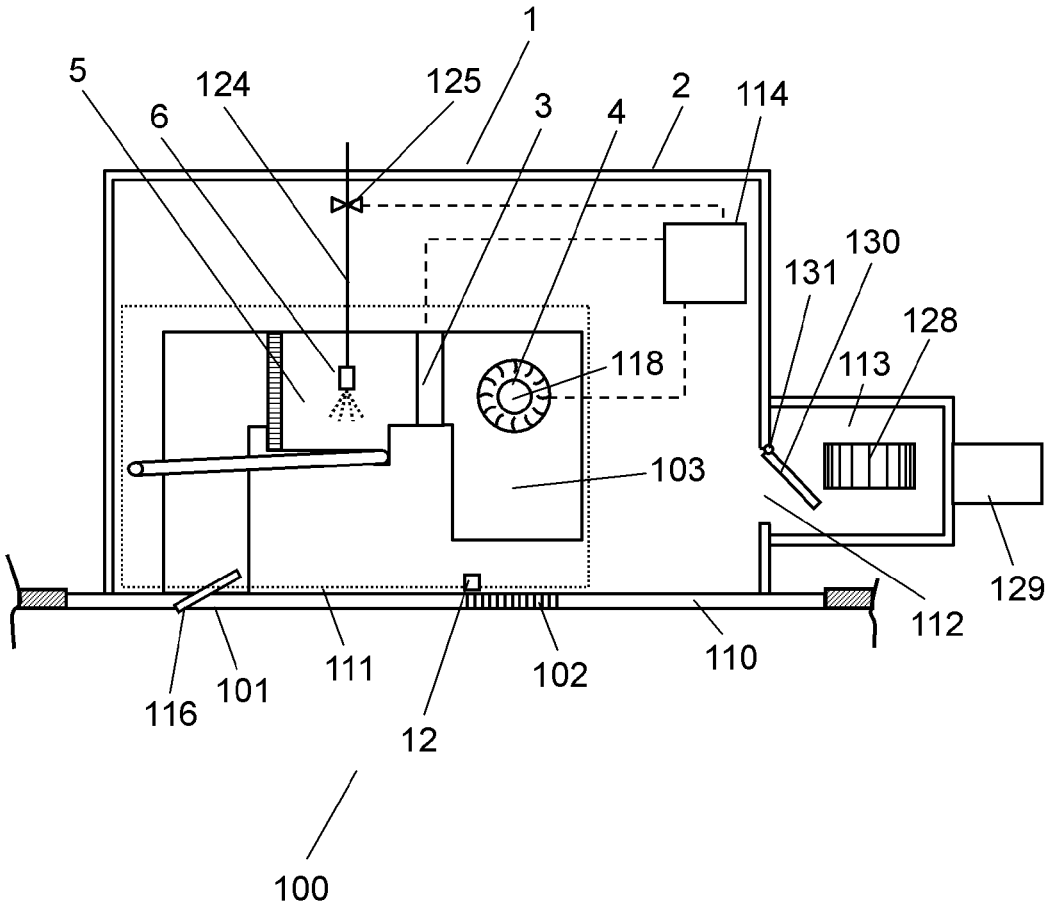
FIG. 1 shows the outline structure of a bathroom sauna device in accordance with an exemplary embodiment of the present invention.

FIG. 1 shows the outline structure of a bathroom sauna device in accordance with an exemplary embodiment of the present invention. As shown in FIG. 1, bathroom sauna device 1 includes outer case 2 and front panel 110 which shape the device contour, sauna module 111 which takes the air of bathroom chamber 100 in to be returned to the bathroom after heating and humidifying it, ventilation unit 113 disposed on the outer surface of outer case 2 at opening 112 connected through with airflow path 103, and control unit 114.

Front panel 110, or one of the panels of outer case 2 at the bathroom side, is provided with air intake 102 for taking air of bathroom chamber 100 in, and blow out opening 101 for blowing heated and humidified air into bathroom chamber 100. Blow out opening 101 is equipped with louver 116 for changing the direction of blowing the heated and humidified air. Thus the movable louver can control the heated and humidified air to any optional direction.

Front panel 110 has airflow path 103, which is connecting air intake 102 for sucking the air of bathroom chamber 100 in and blow out opening 101. Temperature sensor 12 disposed at the air intake 102 side of airflow path 103 watches the temperature of absorbed air. In accordance with a pre-set temperature, control unit 114 starts operation of cross flow fan 4 by activating motor 118 whose revolving speed is variable. Thus the air is sent from the intake 102 side towards blow out opening 101. Heater 3 is provided in airflow path 103 at the downstream side of cross flow fan 4, for heating the air to be heated and humidified, for the purpose of higher relative humidity. Furthermore, humidifying section 5 is provided at the downstream side of heater 3.

The air sucked into by cross flow fan 4 via air intake 102 is heated by heater 3 to be sent as the high temperature air into humidifying section 5. The high temperature air coming into humidifying section 5 encounters with warm water whose temperature is higher than that of the air of bathroom chamber 100. The warm water is supplied via water supply channel 124 equipped with electro-magnetic valve 125 for opening/closing the water supply and sprayed through spray nozzle 6 in the form of micro water particles. The high temperature air is thus humidified efficiently. By the spray humidification, inside of bathroom chamber 100 is humidified to be 70~100% RH, for example.

Ventilation unit 113 is formed of ventilation fan 128 for sucking the air of bathroom chamber 100, and discharge duct 129 which provides a discharge airflow path for ventilating. Ventilation unit 113 is coupled with one of the surfaces of outer case 2 via opening 112 and damper 130 for varying the open area of opening 112.

Damper 130 is normally closed during sauna operation. It can be opened or closed by means of damper control motor 131, which is activated by control unit 114. The air in bathroom chamber 100 can be ventilated by putting ventilation fan 128 into operation. Damper 130 opens, the air in bathroom chamber 100 is sucked out via air intake 102 into ventilation unit 113 to be blown out of bathroom chamber 100 through discharge duct 129.

As described in the above, the humidity of air to be sent to bathroom chamber 100 can be raised to be higher by disposing a heating device at the upstream side of airflow path 103 and a humidifying device at the downstream of the heating device. This is because higher the air temperature the more humidity can be contained in the air.

Figure 2A:
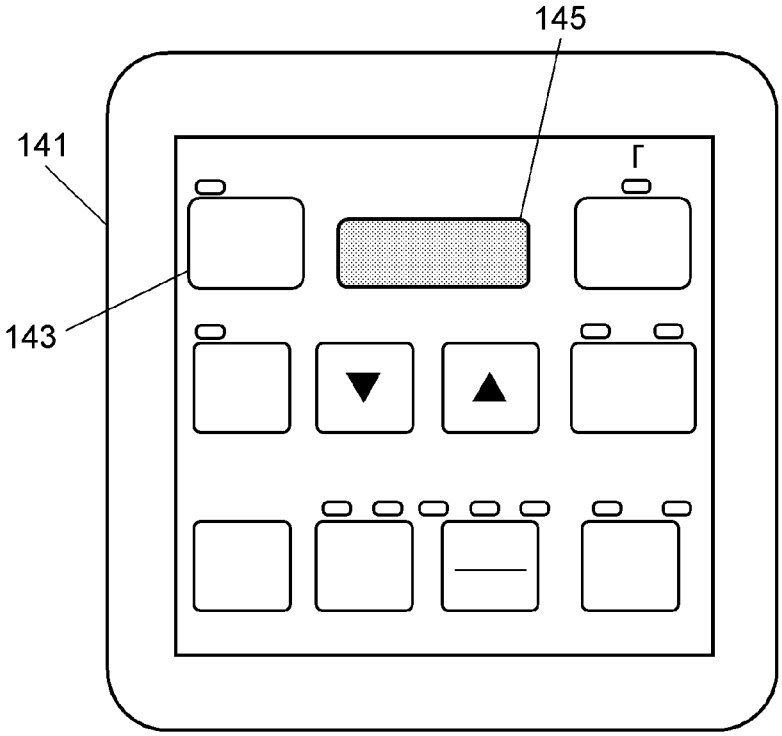
FIG. 2A shows the appearance of the bathroom sauna device controller, for installation outside a bathroom chamber.
Figure 2B:
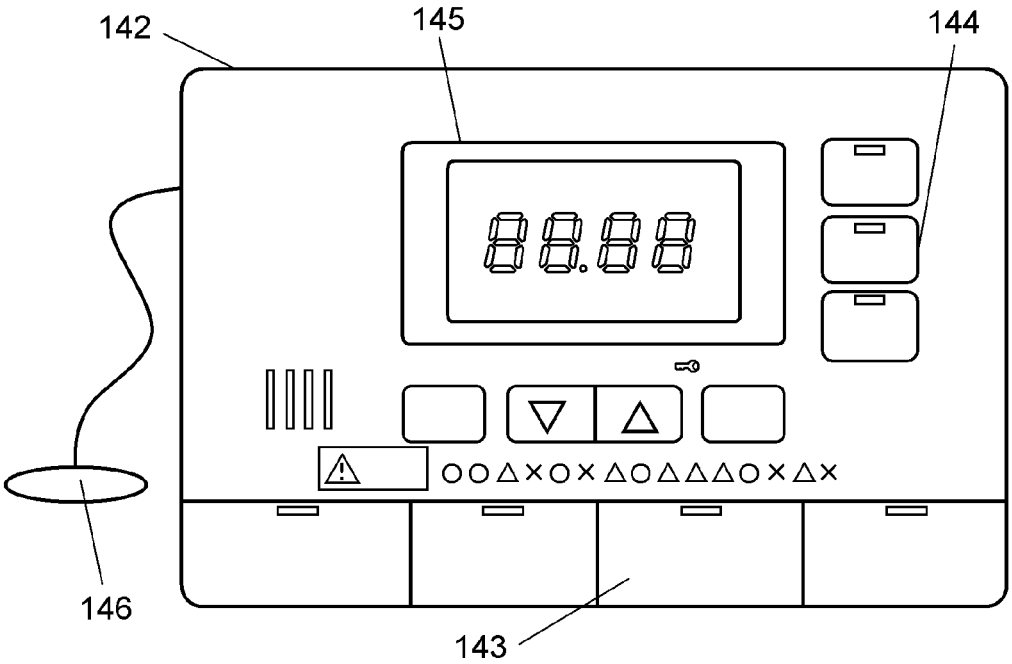
FIG. 2B shows the appearance of the bathroom sauna device controller, for installation in the bathroom chamber.

FIG. 2A shows the appearance of a controller for bathroom sauna device in an exemplary embodiment of the present invention, for installation outside the sauna bathroom chamber. FIG. 2B shows the appearance of a controller for bathroom sauna device, for installation in the inside of sauna bathroom chamber. Controller 141 is for installation outside the sauna bathroom chamber (not shown), while controller 142 is for installation in the inside of the sauna bathroom chamber (not shown). Controller 141 (outside of the chamber) and controller 142 (inside the chamber) are provided with skin moistening mode switch 143 for the skin moistening mode, while controller 142 has sweat sensor 146. During the skin moistening mode, as soon as sweat sensor 146 detects sweating of bathing person, it sends signal to the control unit of sauna device to have the bathroom temperature controlled automatically to a sweat suppression level.

For sauna bathing, the bathroom temperature is raised beforehand to a certain specific temperature. In a case where the bathroom temperature is automatically controlled by sweat sensor 146, initial temperature for the skin moistening mode is pre-set at e.g. approximately 35° C. When bathroom temperature reaches at 35° C., a bathing person enters the sauna chamber, and sweat sensor 146 starts watching his or her sweating. As soon as the body of bathing person is adapted to the bathroom temperature 35° C. and sweat sensor 146 detects sweating, the pre-set bathroom temperature is lowered by 1° C. in order to suppress the sweating. The bathroom temperature is maintained at the lowered level.

If the sweating is not suppressed successfully, the bathroom temperature setting is lowered further by 1° C. The lowering of bathroom temperature is continued until the temperature reaches a level where the sweating is successfully suppressed. The new temperature setting is maintained. When no sweating is detected any more, the bathroom temperature setting is raised by 1° C. Thenceforth, the above-described procedure is repeated to find out sweating temperature, and the bathroom temperature is kept maintained at a temperature 1° C. lower than the sweating temperature.

Although in the above passages the bathroom temperature is described to be maintained at 1° C. lower than a bathing person's sweating temperature, it is not the intention of the present invention to limit the temperature setting as such. The point is that the temperature should be at a level where pores of the skin are enlarged while sweating is suppressed. A preferred temperature setting may be at just before he or she starts sweating; for example, approximately 0.1° C.~2° C. lower than sweat-starting temperature. Although there may be person-to-person difference in the temperature and humidity at which human being starts sweating, bathroom can be maintained in such condition in accordance with the present invention; temperature 35° C., relative humidity 80%, viz. immediately before sweating.

By setting the bathroom temperature and humidity as described in the above, pores of the skin become enlarged while sweating is suppressed. The skin can absorb abundant humidity out of the bathroom air, which humidity permeates into the skin to produce a feeling being moistened. Meanwhile, since sweating has been suppressed, the intrinsic moisture-keeping mechanism of the skin would never be impaired because the moisture-keeping component can not be washed out of the skin by a sweating, the component can not be removed by a towel, which could be used by a bathing person for wiping a sweat. The condition of suppressed sweating means a state where sweat is suspended from flowing out of the skin. In other words, sweat stays at the exit before it oozes out; it will evaporate spontaneously, so it is not necessary to wipe it off. In this situation, the intrinsic moisture-keeping mechanism can not be impaired.

The skin can absorb the more humidity in a high humidity/temperature ambient. The inside of bathroom chamber is sufficiently heated and humidified with such hot air of high relative humidity. Pores of the skin are covered, like other part of the skin surface, with the water-absorbing epidermis of stratum corneum. So, enlarged pores can take more humidity into the skin.

Sweat sensor 146 is for watching a change in the resistance value of weak electricity between two points of the skin. A couple of sensor pads may be attached on any sweating places of the skin since the eccrine gland is found any part of the body. However, it should preferably be attached somewhere in the upper half of body because the objective is for keeping the face skin well moistened.

In the manual temperature setting of bathroom chamber, temperature of the skin moistening mode can be set at a certain notch out of 5 notches in a range from 31° C. to 39° C., at a 2° C. pitch ups and downs with 35° C. as the reference temperature. At controller 141 (outside the chamber), by pressing skin moistening mode switch button 143 for more than 1 sec., temperature display 145 will exhibit the 5 notches from [1] to [5] one after the other for the manual switching. At controller 142 (inside the chamber), a bathing person can switch the temperature displayed on temperature display 145 using temperature setting switch 144 to a desired setting in accordance with his or her optional bathing style.

When one wants to finish bathing within a short time, set the temperature at a high side, e.g. 39° C., in order to have the skin pore enlarged quickly, apply a cosmetic lotion for keeping the moisture as soon as sweating starts. Thus, he or she can get out of bathroom chamber quickly. On the other hand, if one wishes to enjoy a relaxed bathing for relatively long time, set the temperature lower, e.g. 31° C. Then, the skin pore slowly becomes enlarged and one can enjoy sauna bathing with sweating suppressed. Since the temperature setting can be changed at controller 142 installed in the bathroom chamber, a bathing person can switch the bathroom temperature to be 1 notch higher before getting out if he or she wishes to have the body temperature raised to be higher. The bathroom sauna device can be used flexibly by the liking of a bathing person.

The temperature 31° C.~39° C. represents, after taking into consideration that there is person-to-person difference in the sensitivity to temperature and the sweating behavior besides a time for bathing, a range of temperatures where the air in bathroom chamber effects to enlarge pores of the skin with sweating suppressed, and the skin can absorb abundant humidity and the moisture-keeping mechanism is not impaired. The temperature 39° C., which is the upper limit of the control, is at the same time the lowest temperature for a sweat-orientated sauna bathing. The temperature 39° C., however, is decided as the highest temperature, because it takes a certain time before sweating starts and the time before sweating is utilized for moisture-keeping care. The bottom limit of temperature control 31° C. represents a temperature at which a bathing person can enjoy sauna bathing without feeling cold.

Preferred reference temperature of the skin moistening mood is 35° C.±1° C. Generally speaking, sweating is difficult to occur at the temperature, whereas the skin can absorb sufficient humidity, and the moisture-keeping mechanism of the skin is not impaired.

Figure 3A:
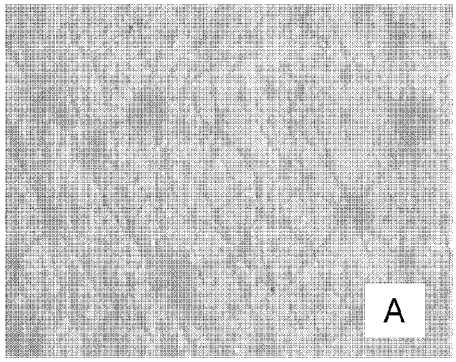
FIG. 3A shows microscopic observation of a face skin before it is washed.
Figure 3B:
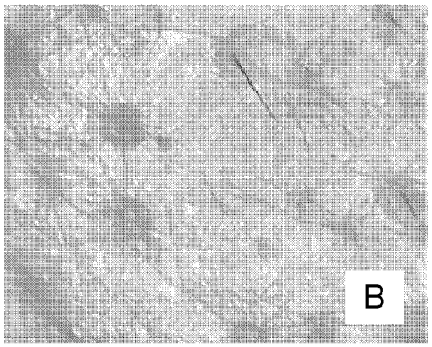
FIG. 3B shows microscopic observation of a face skin after it was washed at an ordinary bathroom.
Figure 3C:
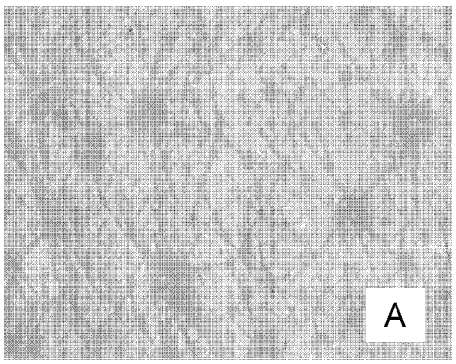
FIG. 3C shows microscopic observation of a face skin washed after it underwent the skin moistening mode of the bathroom sauna device in accordance with an embodiment of the present invention.

Now, the advantage of the skin moistening mode of a bathroom sauna device is described in accordance with an exemplary embodiment of the present invention. FIG. 3A shows a microscopic observation of face skin before washing. FIG. 3B is a microscopic observation of face skin after it was washed at an ordinary bathroom. FIG. 3C is a microscopic observation of a face skin washed after undergoing the skin moistening mode of bathroom sauna device in accordance with an exemplary embodiment of the present invention. Observing FIG. 3A, before washing, and FIG. 3B, after washing in an ordinary bathroom; pearly particles and lame substance of skin foundation are observed around pores of the skin and in the fine grooves of delicate skin texture. Namely, cosmetic materials applied before washing still remain unwashed, and the skin surface looks dry and the texture lacks soft and abundant impression. In comparison with these, the washed face skin after it underwent the skin moistening mode, FIG. 3C, exhibits soft surface of the skin with pores enlarged and free of residual cosmetics. Still further, the skin texture looks fine and delicate, rich with sufficient moisture in it. Thus, it has been confirmed that the skin moistening mode enlarged pores of the skin, removed stains, and offered the skin tissue that is enriched with sufficient amount of moisture.

Figure 4:
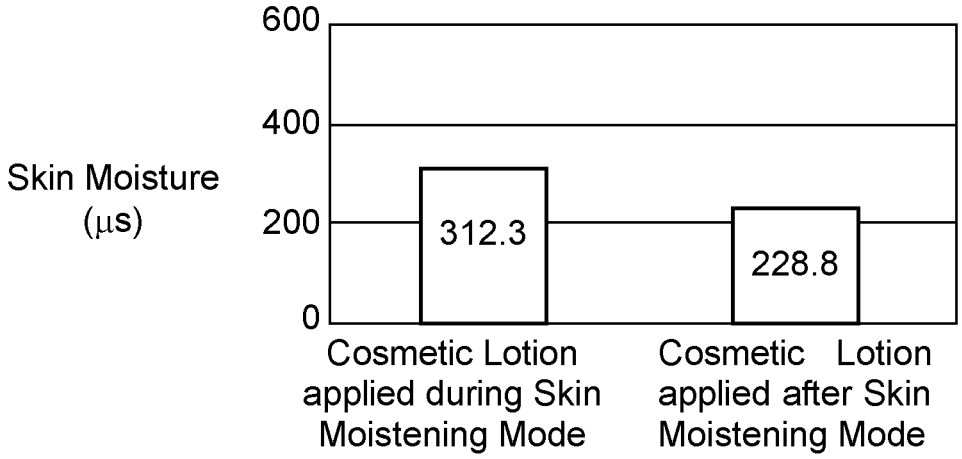
FIG. 4 is a chart showing the moisture keeping effects, used to describe the advantage caused as the result of application of cosmetic lotion made at the skin moistening mode in the bathroom sauna device.

FIG. 4 shows results of measurement of the humidity amount contained in the skin. The chart is used to describe the moisture-keeping effect of a cosmetic lotion applied at the skin moistening mode of a bathroom sauna device in accordance with an exemplary embodiment of the present invention. The application of cosmetic lotion during the skin moistening mode and the application of cosmetic lotion after undergoing the skin moistening mode were compared. In the former case, the environmental temperature/humidity condition in bathroom chamber softens the skin and enlarges the pore making it easy for the micro particles of mist to permeate into the skin. The mist makes it difficult for the skin to get wet and generate sweat; so, a cosmetic lotion applied does not flow away easily, it effectively stays there. As compared with the latter case, application of cosmetic lotion during the skin moistening mode resulted in a 1.4 times as much amount of humidity kept in the skin; in a measurement after 45 min. bathing in the skin moistening mode. (The significance has been attested by the test).

Figure 5A:
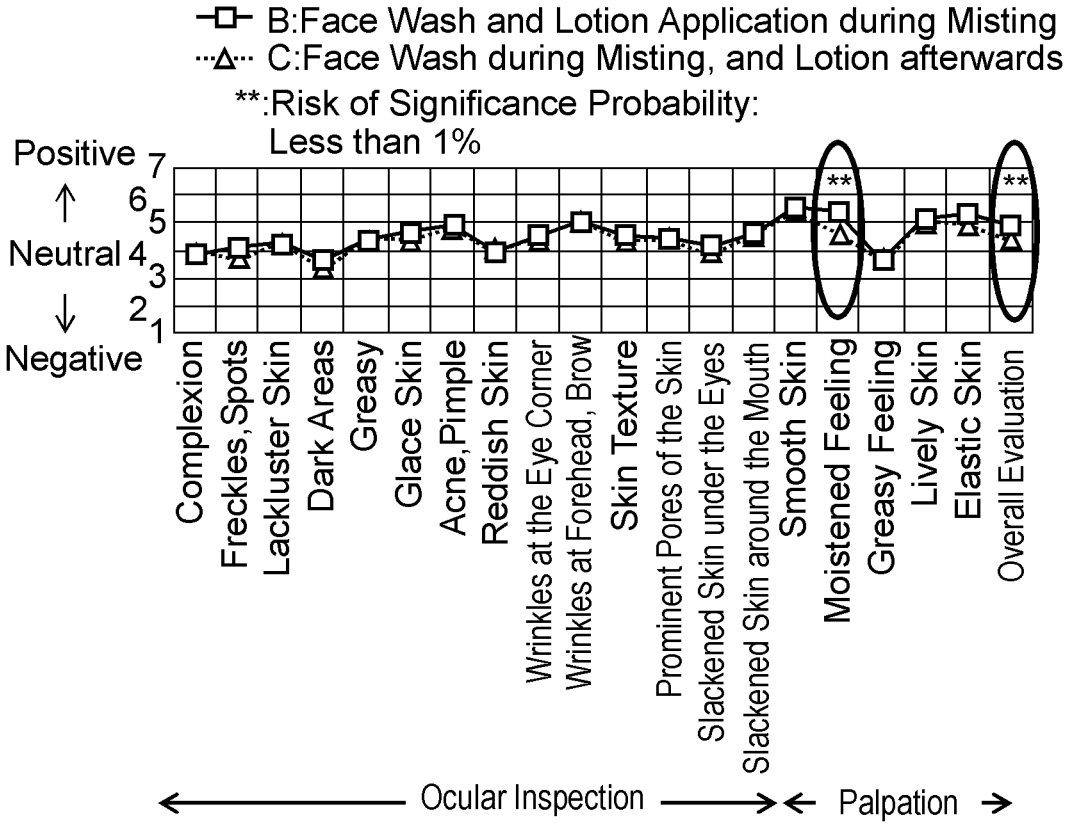
FIG. 5A shows the results of diagnosis made by an esthetic research specialist on the skin after application of a lotion as per FIG. 4.
Figure 5B:
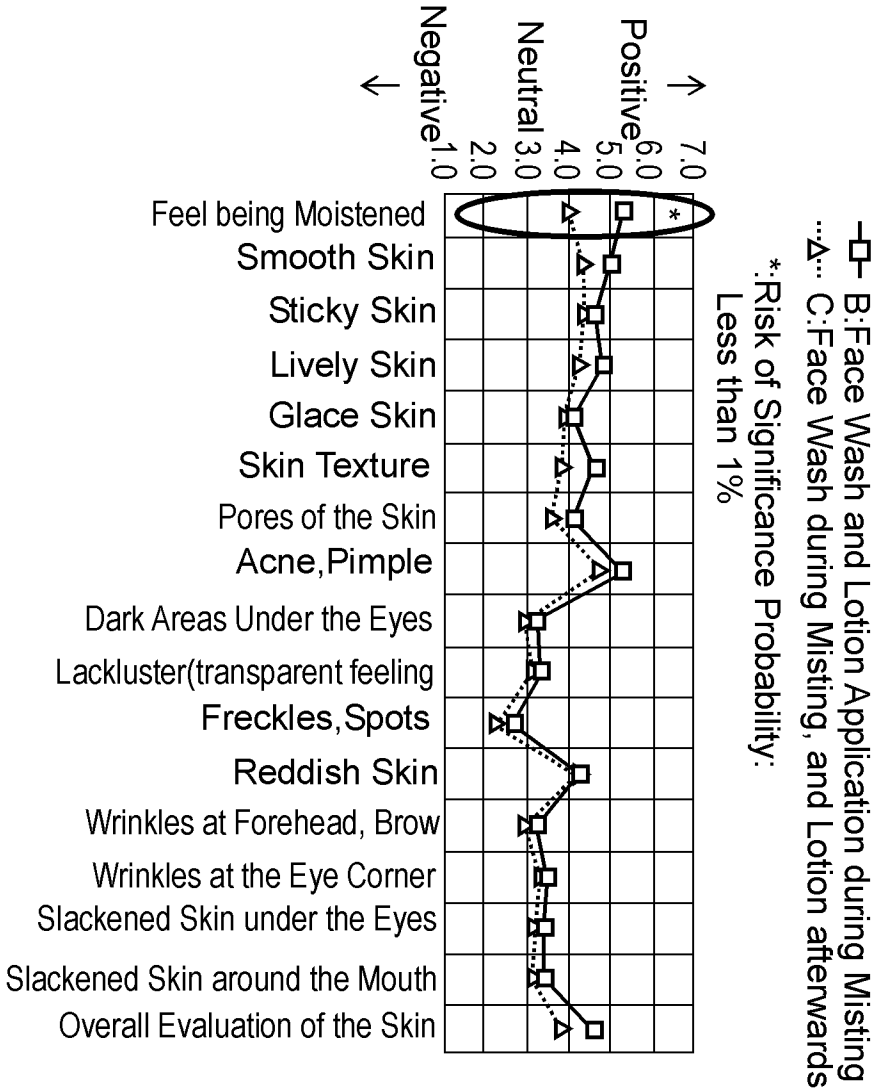
FIG. 5B shows the self evaluation declared by a monitoring person who experimented the lotion application as per FIG. 4.

FIG. 5A shows the results of diagnosis made by an esthetic research specialist on the skin after a cosmetic lotion was applied as per FIG. 4. FIG. 5B shows the self evaluation declared by a monitoring person who experimented the application of cosmetic lotion as per FIG. 4. According to the results of diagnosis made by the esthetic research expert shown in FIG. 5A, the face washing and cosmetic lotion application conducted during mist treatment in the skin moistening mode bears positive meaningful difference in the favorable direction with respect to the items "Moistened Feeling" and "Overall Evaluation". In FIG. 5B, self evaluation declared by a monitoring person, the face washing and cosmetic lotion application conducted during mist treatment in the skin moistening mode bears positive meaningful difference in the favorable direction with respect to the item "Feel being Moistened". Thus, the targeted advantage point of moisture-keeping has been affirmed.

Since the sweat generated during bathing does not contain unpleasant smell, it is generally recommended not to wipe it off, leave it to the spontaneous evaporation. In the normal behavior, however, people tend to wipe it off when sweat flows out. Therefore, the flowing of sweat should be prevented. By so doing, the moisture-keeping effects provided by the cosmetic lotion application will be further enhanced.

The mechanism for keeping the absorbed humidity within the skin includes the skin surface lipids and the moisture-keeping component included in a cosmetic lotion having equivalent performance. The lipids excreted from sebaceous gland in hair follicle inside the pore are mixed with water to form a film. Although the film itself is a greasy substance, it can be mixed with water component by the action of an emulsifying agent contained in the lipids. Normally, the sweat is utilized for the water component, but moisturizing water is considered to play the same role. Sometimes sweats may ooze out even in a sweat-suppressed condition. The sweat thus generated and the lipids may sometimes produce a film of lipids.

The lipids film, or a moisture-keeping mechanism, is provided basically as the result of functioning of the human body. In addition, a cosmetic lotion is often applied aiming to enhance the function by taking advantage of a moisture-keeping component included in the cosmetic lotion. However, since cosmetic lotion is normally applied after bathing, the moisture-keeping function deteriorates along with the lapse of time. So, the enhancing effect is not as high as generally believed to be.

In the skin-moistening mode where one can enjoy bathing without feeling the water particles he or she will not be compelled to wipe sweat off with a towel unless sweat starts to flow out. Therefore, the film of lipids or the like components essential to the moisture-keeping mechanism would seldom be removed, cosmetic lotion containing moisture-keeping component applied on the skin would hardly be washed down by sweat, or the film of lipids or the like moisture-keeping components would not be washed down by sweat. Thus the moisture-keeping mechanism can survive intact.

Figure 6A:
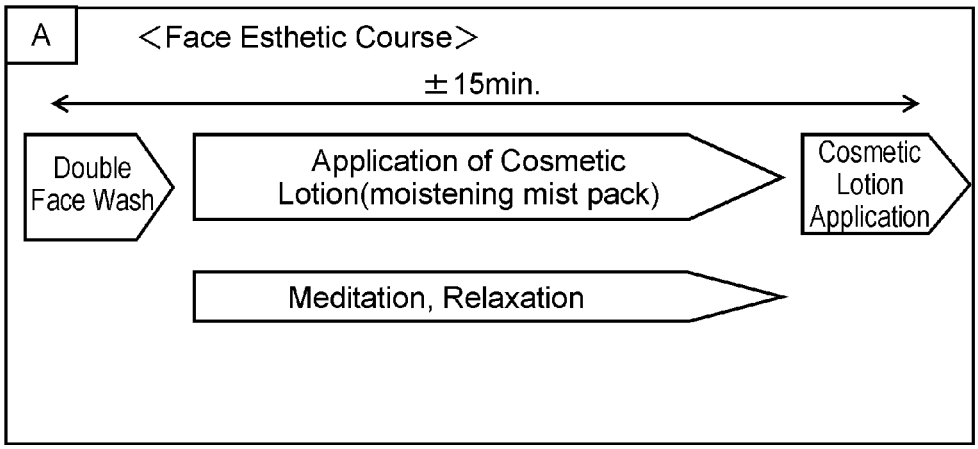
FIG. 6A shows standard skin and hair care course of the skin moistening mode provided by the bathroom sauna device in accordance with an exemplary embodiment of the present invention.
Figure 6B:
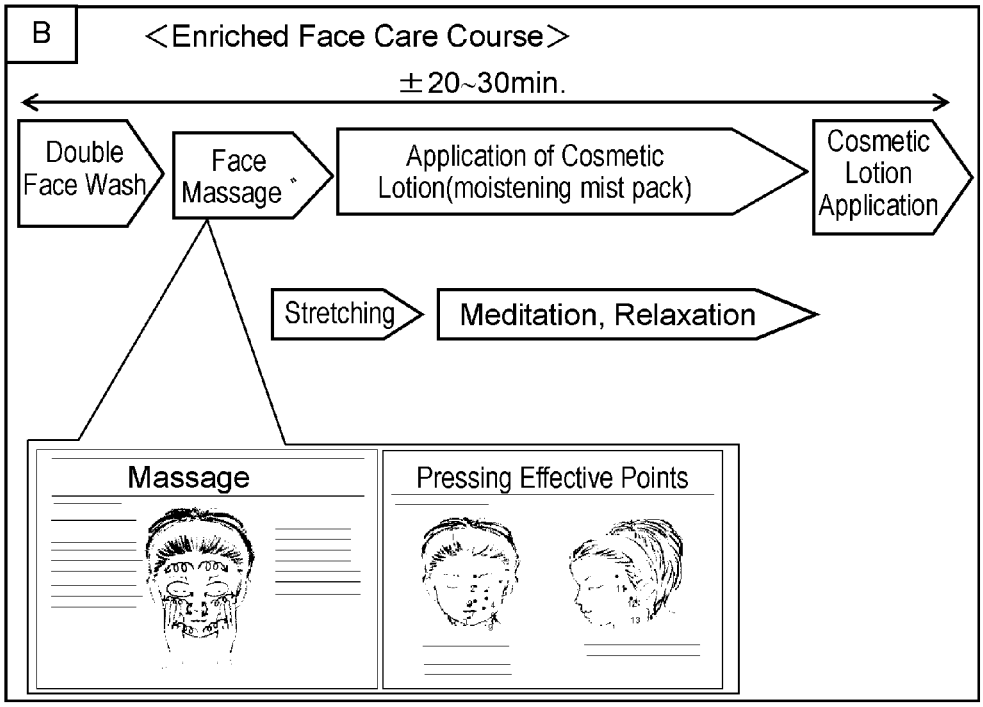
FIG. 6B shows optional course of the skin moistening mode provided by the bathroom sauna device.

FIG. 6A shows standard skin and hair care course of facial esthetics course in the skin moistening mode provided by a bathroom sauna device in accordance with an exemplary embodiment of the present invention. FIG. 6B shows optional course of facial esthetics course in the skin moistening mode provided by the bathroom sauna device. In the skin moistening mode of FIG. 6A, one can enjoy the standard skin and hair care course, and the optional beauty course of FIG. 6B for skin care and hair care. Thus, the skin moistening care can be offered more efficiently in accordance with the present invention. Furthermore, a massage and the like treatments which activate blood circulation may be added to for a premium beauty promotion service.

Taking advantage of the natures of mist that it keeps things from getting wet and that it can not be seen by the eye, a bathing person can read books or watch TV in a bathroom chamber, at the same time vigorously absorb moisture and apply cosmetic lotion to the skin for enhancing moisture-keeping function.

Figure 7:
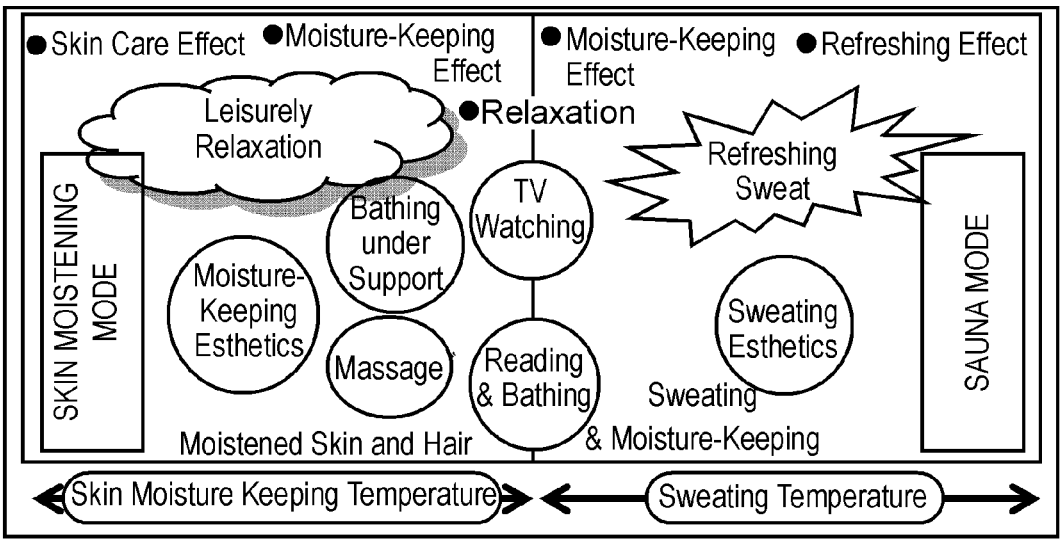
FIG. 7 illustrates a variety of bathing styles that can be offered by the bathroom sauna device.

FIG. 7 illustrates how a bathroom sauna device in the present invention can adapt to varieties of bathing styles of individuals. As shown in FIG. 7, one can select the skin moistening mode or the sauna mode aimed for sweating. Especially, the skin moistening mode bears the less load to the human body, so it can be readily adapted with various styles of bathing, such as an esthetics course aimed for the moisture-keeping, that for the massage treatment, etc.

Now, the structure of a bathroom sauna device, including its operation, is described in detail in accordance with an exemplary embodiment of the present invention.

Figure 8:
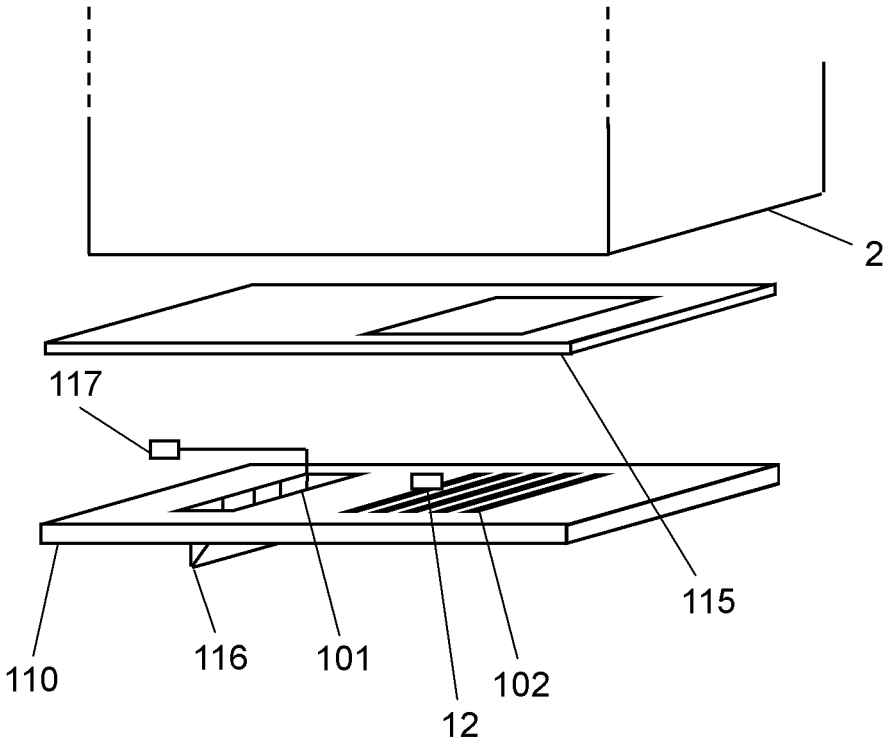
FIG. 8 shows the structure of front panel of the bathroom sauna device.

FIG. 8 shows the structure of front panel of a bathroom sauna device in accordance with an exemplary embodiment of the present invention. Filter 115 is provided at the inside of air intake 102 in order to prevent small dusts and particles from intruding into the circulating air of bathroom chamber. The direction of louver 116 can be shifted at option by louver control motor 117, so the air can be blown out to any desired direction.

Figure 9:
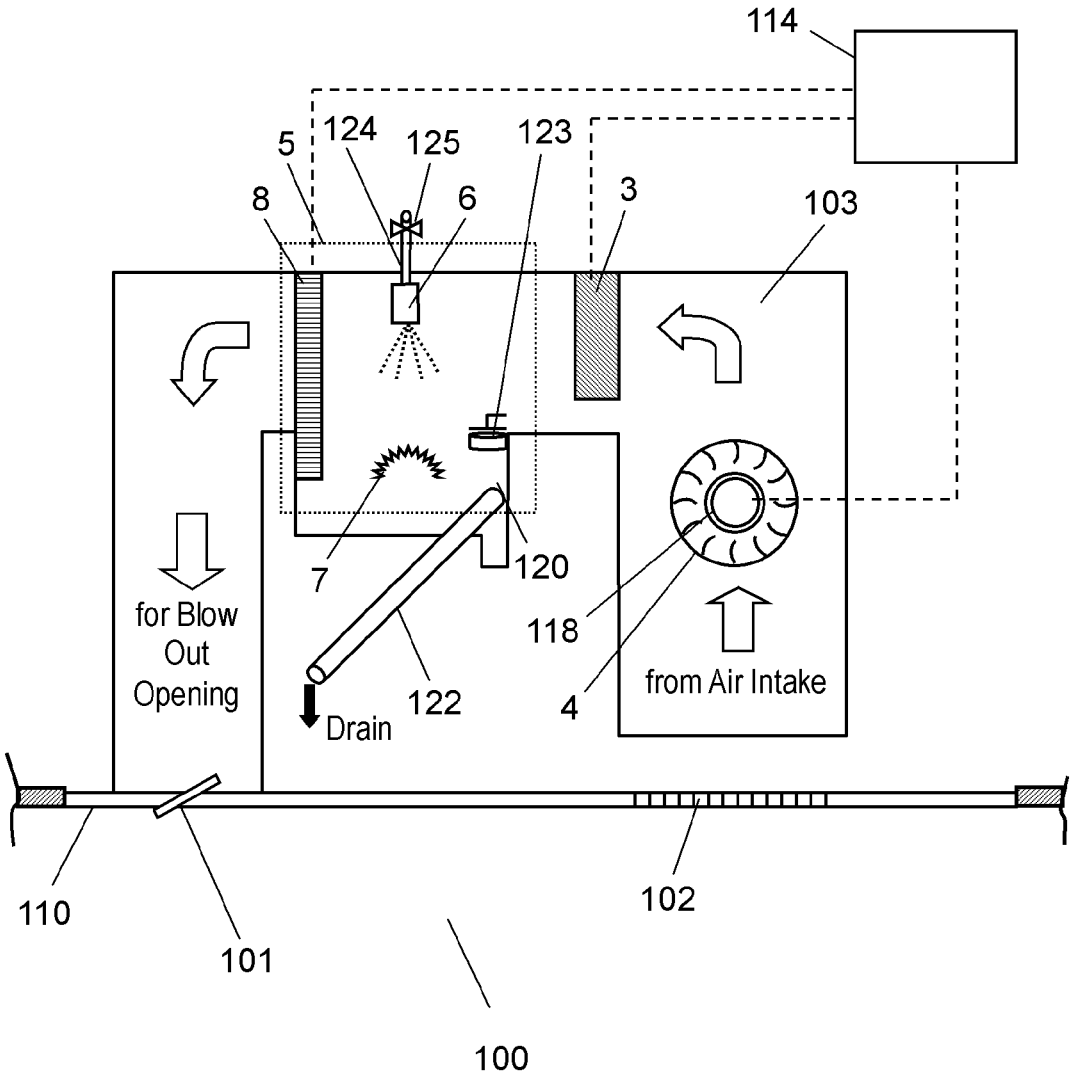
FIG. 9 shows the structure of sauna module of the bathroom sauna device.

FIG. 9 shows how a sauna module of bathroom sauna device is structured in accordance with an exemplary embodiment of the present invention. As shown in FIG. 9, humidifying section 5 is provided in airflow path 103 at the downstream side of cross flow fan 4. Spray nozzle 6 in humidifying section 5 is supplied with warm water, which is sprayed in the form of fine particles of water.

In the above-described layout where humidifying section 5 is disposed at the downstream of cross flow fan 4, a possible dew condensation caused as the result of contact of the humidified air with cross flow fan 4 can be avoided. Thus the humidifying operation can be conducted efficiently.

Warm water supply is advantageous in that the warm water does not cause a significant lowering in the temperature of the air to be humidified, and the air can send higher amount of humidity to bathroom chamber 100.

Water particle crusher 7 is provided at a location ahead of the spray direction for crushing the sprayed water particles into the finer particles. Fine particles (e.g. less than 100 μm diameter) are carried by the airflow to blow out opening 101 for humidifying a bathroom chamber. Those water particles remaining un-crushed are led to drain section 120. Among the fine particles carried by the airflow, those relatively large-sized ones (e.g. 10~100 μm diameter) are collected at eliminator 8 disposed at the blow out opening 101 side of humidifying section 5. They are led to drain section 120. Those fine water particles which went through eliminator 8 (particle diameter less than 10 μm) proceed to bathroom chamber 100 together with the air heated by heater 3, for heating and humidifying the chamber.

As the result of crushing executed by water particle crusher 7 on the sprayed water particles, an increased number of particles crushed into finer water particles can go through eliminator 8 to deliver humidity to bathroom chamber 100.

Eliminator 8 is formed of a plurality of coarse mesh materials laminated. Eliminator 8 renders a bulky conventional meandering type airflow path formed with air guide boards to be unnecessary. Moreover, the pressure loss exhibited by the eliminator is relatively small. The essential function of water particle crusher 7 is to crush the particles sprayed from spray nozzle 6 into finer particles. So, a crash board, a revolving board, a board of roughened surface, etc. disposed against spray nozzle 6 may be used instead for the same purpose.

By providing the air of absolute humidity higher than 0.011 kg/kg' by making use of water particle crusher 7, and sending the air to the bathroom chamber, a humidification can be realized to be higher than the dew condensation at the wall surface of bathroom chamber. Furthermore, by continuing the supply of air having an absolute humidity higher than 0.011 kg/kg' to the airflow, which is circulating bathroom chamber by way of the bathroom sauna device, the humidity will accumulate to raise the humidity of bathroom chamber to as high as 80%, or even higher.

Figure 10:
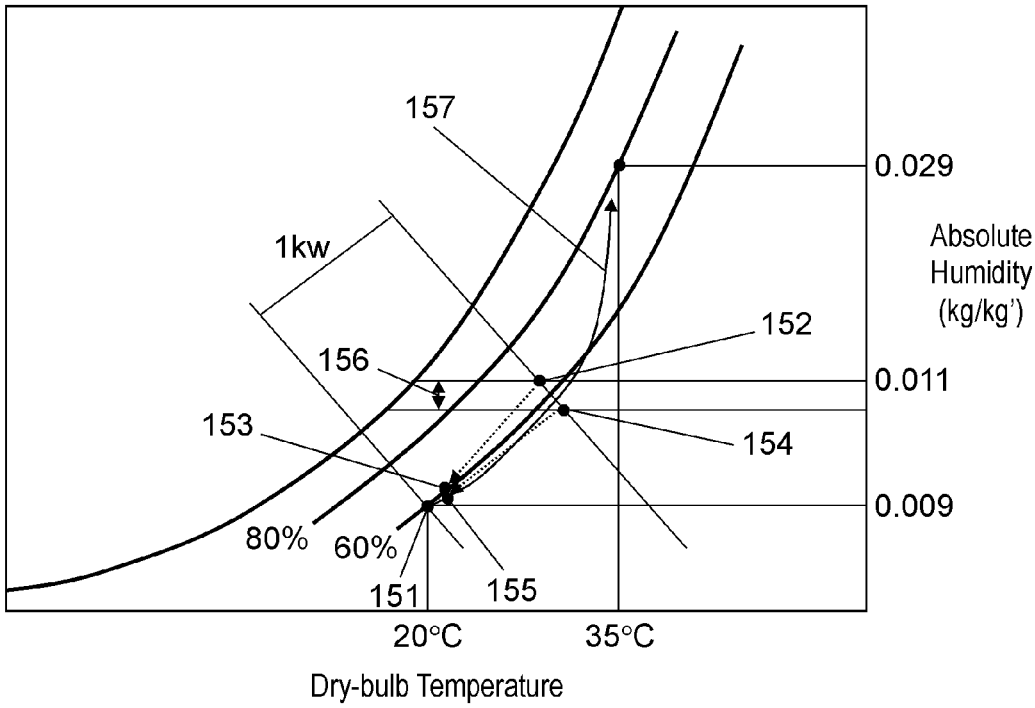
FIG. 10 shows the air chart of the bathroom chamber driven by the bathroom sauna device.

FIG. 10 is an air chart of bathroom chamber which is operated by a bathroom sauna device in accordance with an exemplary embodiment of the present invention. In a 3.3 $m^2$ bathroom chamber, for example, suppose the bathroom initial temperature point A151 to be 20° C., 60%, and the air of absolute humidity 0.011 kg/kg' blows out at point B152, then the air of point A151 and the air of point B152 are mingled together reaching at point C153. In reality, however, because of dew condensation at the wall surface 156 of bathroom chamber the air at point B152 comes down to point D154, the airs at point D154 and point A151 are mixed together to become point E155.

After the procedures are repeated, it is accumulated in line with line A157. This enables to raise the humidity of bathroom chamber to absolute humidity 0.029 kg/kg' or higher. If the air lower than absolute humidity 0.011 kg/kg' is sent, it takes a long time before the humidity of bathroom chamber is raised. Further, if point D154 turned out to be lower than absolute humidity 0.009 kg/kg' due to dew condensation on the wall surface, no humidification is taken place. Therefore, it is essential that the supplied air has the absolute humidity 0.011 kg/kg' or higher.

The humidity led to drain section 120 is discharged outside humidifying section 5 via drain pipe 122. Drain section 120 is placed at the lower part of humidifying section 5, and the bottom is inclined so as the drain pipe is connected at the lowermost point of the bottom plane. In this structure, redundant water can not stay in humidifying section 5. As to the angle of bottom inclination, the greater angle will theoretically ensure complete draining. In practice, an inclination not less than 5° is enough for discharging redundant water of humidifying section 5 without fail.

Likewise, the drain pipe connected at the outside of humidifying section 5 is to be inclined for not less than 5° in order to prevent the redundant water from staying in humidifying section 5. Furthermore, drain section 120 is provided with float switch 123 for detecting a rising water level in drain section 120. If the water level became higher than a certain predetermined level, control unit 114 halts water supply to spray nozzle 6 in order to prevent a possible leakage of water out of humidifying section 5.

Electro-magnetic valve 125 is provided in water supply channel 124. Supply of humidifying water can be controlled in the amount by opening/closing the valve. Electro-magnetic valve 125 is a valve which is opened and closed with an electromagnetic power activated by electrical signals.

Figure 11:
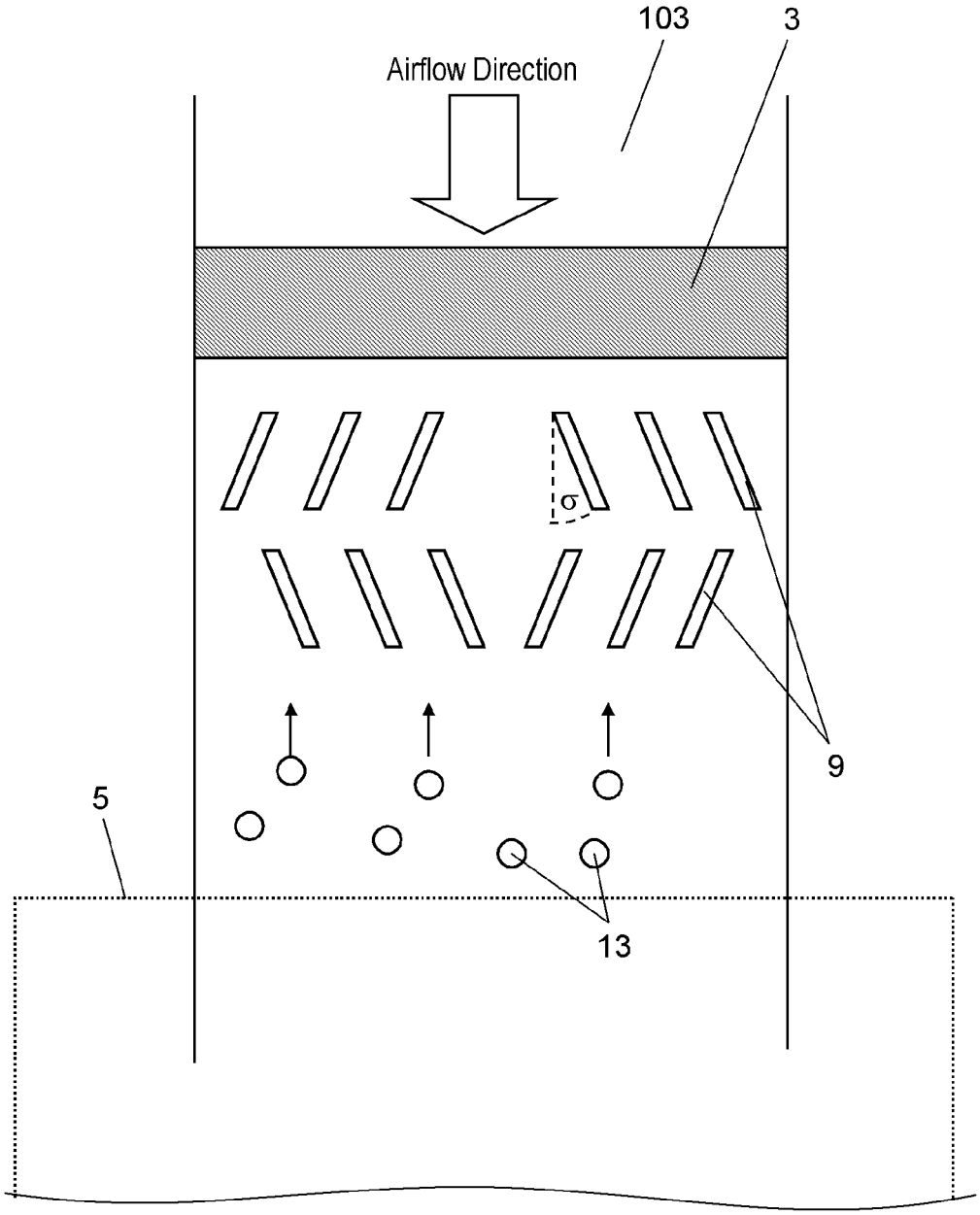
FIG. 11 illustrates the outline structure of anti-splash plates disposed in sauna module of the bathroom sauna device.

FIG. 11 illustrates the outline structure of anti-splash plates disposed in sauna module of a bathroom sauna device in accordance with an exemplary embodiment of the present invention. In order to prevent splashing water particles 13, which come from humidifying section 5, from sticking on heater 3, anti-splash plates 9 are provided at a place which is in the downstream of heater 3 and upstream of humidifying section 5. Anti-splash plates 9 are disposed at a certain slant angle with respect to the airflow direction. These plates can effectively avoid the splashing water particles while minimizing a negative influence to the airflow.

Figure 12:
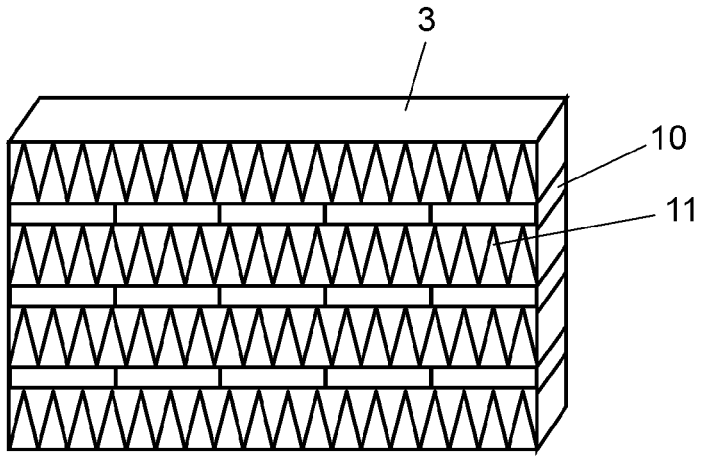
FIG. 12 shows the outline structure of air heating device disposed in the bathroom sauna device.

FIG. 12 shows the outline structure of a means for heating the air in a bathroom sauna device in accordance with an exemplary embodiment of the present invention. Heater 3 is formed of a ceramic or other heat generating element 10 integrated with heat conducting fin 11 for promoting heat transmission to the air. Upon activation with electric power, heat generating element 10 generates heat to raise the temperature of heat conducting fin 11, and then the heated heat conducting fin 11 heats the ambient air. The surfaces of heat generating element 10 and heat conducting fin 11 are electrically insulated. Therefore, even if splashing water particles or other items stuck on it, there would be no electric leakage or the like trouble.

Figure 13:
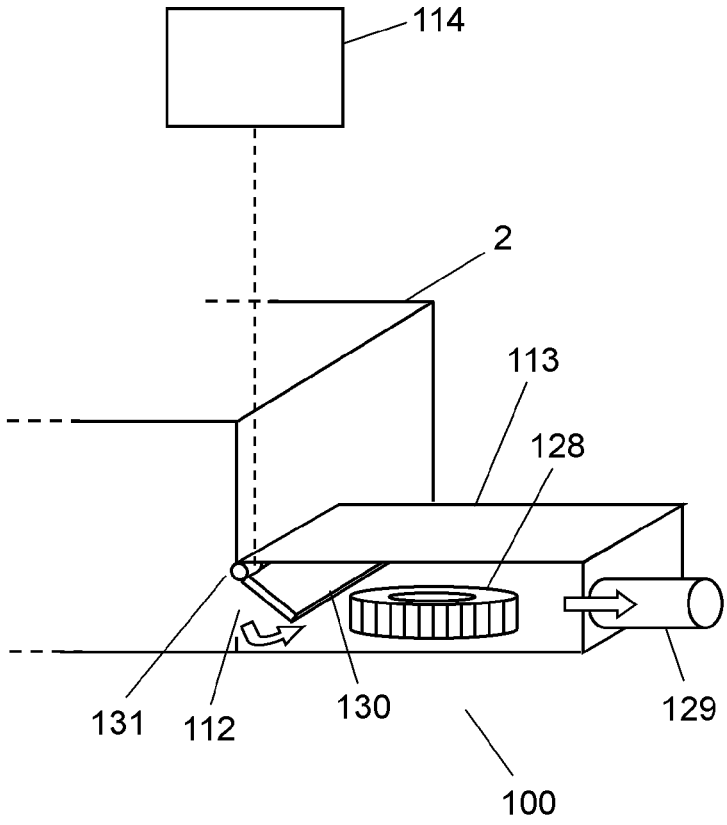
FIG. 13 illustrates the outline structure of air ventilation unit in the bathroom sauna device.
Figure 14:
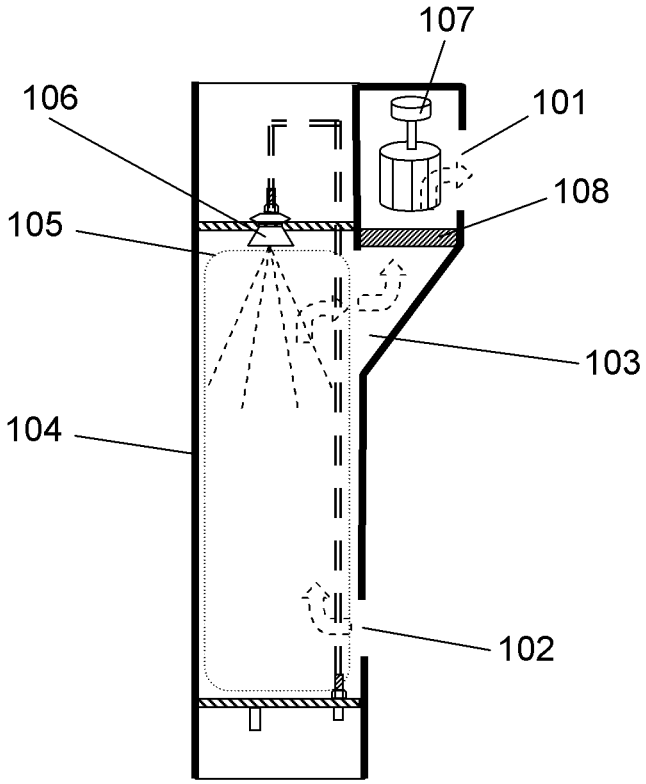
FIG. 14 PRIOR ART
FIG. 14 shows the outline structure of a conventional bathroom sauna device.

FIG. 13 illustrates the outline structure of air ventilation unit in a bathroom sauna device in accordance with an exemplary embodiment of the present invention. The amount of ventilation can be controlled by changing the open area for damper 130 and the revolving speed of ventilation fan 128. A desired amount of ventilation can be performed by a combined use of these control means.

Now, control unit 114 of bathroom sauna device 1 is detailed referring to FIG. 1.

When sauna device is put into operation in the skin moistening mode or the sauna mode, motor 118 disposed in sauna module 111 starts revolving cross flow fan 4. The air in bathroom chamber 100 is sucked from air intake 102, proceeds through airflow path 103 to be blown out from blow out opening 101 for circulation in bathroom chamber 100. Electric power is delivered to heater 3 for heating the air, and electro-magnetic valve 125 for opening/closing water supply channel 124 is activated to start delivering humidifying water to spray nozzle 6 of humidifying section 5. Thus, the bathroom sauna device starts heating and humidifying the air of bathroom chamber 100. When, louver 116 at front panel 110 is revolved to control the blow out direction of the heated and humidified air.

After some time is elapsed, as soon as the temperature and humidity in bathroom chamber 100 reach a certain predetermined value, it begins adjustment of the chamber temperature starting from a temperature which is slightly lower than a predetermined temperature. Suppose, pre-set temperature for the skin moistening mode is approximately 35° C., the adjustment starts at approximately 34° C., 80% RH. At this stage, revolution speed of motor 118 is shifted for changing the amount of heating and humidifying. After about 5 min., for example, the temperature and humidity of bathroom chamber 100 will be rising to exceed the pre-set temperature for skin moistening mode, e.g. 35° C., arriving at slightly higher level, e.g. approximately 36° C., 80% RH. Then, the temperature and humidity of bathroom chamber are controlled by shifting the revolving speed of motor 118 and power supply to the heater, and repeating open/close operation of electro-magnetic valve 125 provided in water supply channel 124. What is meant by the temperature "arriving at slightly higher level e.g. approximately 36° C." in the above description is to offer a certain margin for the temperature control.

Although the relative humidity in the present embodiment is an inference based on the temperature measured by temperature sensor 12, the temperature and the humidity may of course be measured respectively using a temperature sensor and a humidity sensor.

For discontinuing the sauna operation, stop the operation of motor 118 in sauna module 111 and close electro-magnetic valve 125 in water supply channel 124. And then, open damper 130 disposed at the junction of outer case 2 and ventilation unit 113 by operating damper control motor 131, in order to have ventilating operation started for drying the inside of bathroom chamber 100. By revolving ventilation fan 128 disposed in ventilation unit 113, the air of bathroom chamber 100 coming in via air intake 102 of bathroom sauna device 1 is discharged to the outside of bathroom chamber 100 through discharge duct 129.

By carrying out the above-described operations, bathroom chamber 100 is made into a space of high temperature and high humidity (approximately 35° C./80%). By providing humidifying section 5 in accordance with an exemplary embodiment of the present invention, water particles having large diameter can be collected within airflow path 103, which makes it possible to send only those of relatively small diameter to the bathroom chamber. Thus, the bulky conventional airflow path of meandering structure can be eliminated.

As the result of the above-described operations, the temperature and humidity of a bathroom chamber can be raised to a certain predetermined level. Thereby, a sauna bathing space that can provide the skin moistening mode and the sauna mode is offered.

A bathroom sauna device structured in accordance with the present invention can afford much amount of humidification. The hot air of high absolute humidity enlarges pores of the skin, and the skin can absorb abundant humidity from the sauna space, which humidity permeates through the skin. Since the temperature is set at sweat-suppressing level, moisture-keeping mechanism of the skin is not impaired.

The descriptions in the present exemplary embodiment of invention are based on an assumption that the bathroom sauna device will be used for providing a sauna bathing space by making use of a bathroom chamber. The object of its application, however, is not limited a bathroom chamber. It may be applied also for providing a separate space designed exclusively for sauna bathing, on condition that the problem of dew condensation in a high humidity space is solved.

Although a ceramic heat generating element is used for the means of heating the airflow in an exemplary embodiment of the present invention, other kinds of heater may be used instead for the same purpose, in so far as it can sufficiently raise the temperature of airflow. A sheathed heater, a nichrome wire heater, a heat exchanger using warm water or coolant, or other types of heat sources may be used for the same effects without any problem.

Humidifying section 5 in an exemplary embodiment of the present invention performs humidification by spraying warm water. However, in a case of small bathroom chamber (approximately 1.7 $m^2$) where the amount of humidification is not much, the air of high relative humidity can be supplied by utilizing a tap water of normal temperature (approximately 20° C.). The temperature of humidifying water which is sprayed from spray nozzle 6 should preferably be adjusted in accordance with the area size of bathroom chamber, ambient temperature outside the bathroom chamber, etc. in order that a targeted temperature and humidity is realized in the bathroom chamber. Besides the humidification by spraying of water, humidification may be made by diffusing small water particles using an ultrasonic oscillator, or supplying humidifying water which has been heated and vaporized.

Water particle crusher 7 in an exemplary embodiment of the present invention is aimed to crush the sprayed water particles into those of smaller diameter. Design and material of the crusher are not limited specifically. Such a device which can crush water particles to be finer by blasting those water particles coming from spray nozzle 6 at a certain speed against a revolving substance, a wall having roughened surface, or a board of certain specific surface material may be used for water particle crusher 7. Water particle crusher 7 should preferably be designed so as the relative speed of water particles with respect to water particle crusher 7 is maximized at the moment of crush, and the crushed water particles are scattered towards many directions. A water particle crusher designed as such will be able to crush the water particles into still finer ones.

The diameter of water particles that go through eliminator 8 is described in an exemplary embodiment of the present invention to be not larger than 10 μm. However, those water particles having diameter not larger than 100 μm would not cause a substantial difficulty. The point is that water particles which go through eliminator 8 and sent into a bathroom chamber should bear a diameter with which a bathing person does not feel being wet. Generally speaking, most people enjoy the bathing without feeling being wet in such a situation where the particle diameter is not larger than 10 μm. Even a cosmetic lotion is applied to the skin, it loses effectiveness if it is wetted as the result of humidification. So, by controlling the diameter of water particles to be non-wetting sizes, the moisture-keeping effect of cosmetic lotion can be preserved. Furthermore, a bathing person would not wipe the face with a towel unless he or she feels wet and uncomfortable. So, skin surface lipids and the like moisture-keeping components will be able to stay as they are.

In an exemplary embodiment of the present invention, a tap water plumbing is connected direct for the liquid supply facility. In case the pressure of water supply is to be increased, the water supply may be pumped up with a pump, etc. without any problem.

Electro-magnetic valve 125 is used as means for opening/closing water supply channel 124 in an exemplary embodiment of the present invention. Other means such as a thermally-activated valve may be used instead for the same purpose. The valve should preferably be a flow control valve which is capable of controlling the temperature and humidity in response to control unit 114. Other point of preference is in the quick response to control signals.

In an exemplary embodiment of the present invention, temperature of the skin moistening mode can be set at a notch out of 5 notches in a range from 31° C. to 39° C., at a 2° C. pitch ups and downs with 35° C. as the reference temperature. However, depending on choice of individuals or the convenience for practical use, the steps of adjustment may be increased to 10 notches at 1° C. pitch.

Industrial Applicability

A heating and humidifying device in the present invention installed coupled with a chamber, which chamber being target of the heating and humidifying, makes it easy to set certain temperature conditions for high humidity chamber. The device can be used also for converting a bed room, a bathroom or other rooms of a residence into a sauna bathing space. Since the device can afford a large amount of humidity, it can be used for a large-scale sauna bath facility.

The invention claimed is:

1. A bathroom sauna device comprising:

a heating device for heating air of a bathroom chamber;

a humidifying device for providing particles of water to humidify the air of the bathroom chamber;

an airflow path for sending the air heated and humidified by the heating device and the humidifying device to the bathroom chamber;

a temperature sensor for monitoring a temperature of the air of the bathroom chamber;

a sweating sensor for detecting sweating of a user of the bathroom sauna device;

wherein when the sweating sensor detects the sweating of the user, the heating device controls the temperature of the air of the bathroom chamber to a condition of temperature before human body starts sweating.

2. The bathroom sauna device of claim 1, wherein the heating device is configured to control the temperature of the bathroom chamber to be within a range from 31° C. to 39° C.

3. The bathroom sauna device of claim 1, wherein an air blower for sending the air to the bathroom chamber is provided in the airflow path, and the humidifying device is disposed at a downstream side of the heating device in the airflow path.

4. The bathroom sauna device of claim 1, wherein the heating device is disposed at an upstream side in the airflow path, the humidifying device is disposed at the downstream side of the heating device.

5. The bathroom sauna device of claim 4, wherein the humidifying device is configured to provide air of absolute humidity 0.011 kg/kg' or higher to be sent to the bathroom chamber.

6. The bathroom sauna device of claim 1, wherein the heating device is configured to control the temperature of the air of the bathroom chamber to be 35° C.±1° C.

7. The bathroom sauna device of claim 1, wherein the heating device is a ceramic heater.

8. The bathroom sauna device of claim 1, wherein the heating device is a sheathed heater.

9. The bathroom sauna device of claim 1, wherein the heating device is a nichrome wire heater.

10. The bathroom sauna device of claim 1, wherein the heating device is a heat exchanger using warm water or coolant.

11. The bathroom sauna device of claim 1, wherein the humidifying device is a spray device which sprays humidifying water to air heated by the heating device.

12. The bathroom sauna device of claim 11, wherein the spray device is configured to spray warm water.

13. The bathroom sauna device of claim 1, wherein the humidifying device supplies humidifying water atomized by an ultrasonic oscillator to air heated by the heating device.

14. The bathroom sauna device of claim 1, wherein the humidifying device supplies humidifying water vaporized by heating to air heated by the heating device.

15. The bathroom sauna device of claim 1, further comprising a water particle crusher for crushing the particles of water into fine particles of water having a diameter of less than 100 μm.

16. The bathroom sauna device of claim 15, further comprising an eliminator for collecting relatively large-sized ones of the fine particles so that only fine particles having a predetermined diameter humidify the air.

17. The bathroom sauna device of claim 16, where the eliminator collects fine particles having a diameter greater than 10 μm as the relatively large-sized ones of the fine particles.

18. The bathroom sauna device of claim 16, where the eliminator collects fine particles having a diameter greater than or equal to 10 μm and less than or equal to 100 μm as the relatively large-sized ones of the fine particles so that only fine particles having a diameter less than 10 μm humidify the air.

* * * * *